US006074094A

United States Patent [19]

Manolizi et al.

[11] Patent Number: 6,074,094

[45] Date of Patent: Jun. 13, 2000

[54] SAFETY LOCKING FOR A BAG

[76] Inventors: Jorge Eleuterio Manolizi; Walter Gabriel Sidlik, both of Av. Libertador 2201 Piso 5, Buenos Aires, Argentina, 1425

[21] Appl. No.: 09/102,332

[22] Filed: Jun. 22, 1998

[30] Foreign Application Priority Data

Jun. 25, 1997 [AR] Argentina ..... 97 01 02789
May 27, 1998 [AR] Argentina ..... 98 01 02447

[51] Int. Cl.[7] ..... B65D 33/02; B65D 33/17

[52] U.S. Cl. ..... 383/5; 24/30.5 L; 383/34.1; 383/69; 383/79; 383/81

[58] Field of Search ..... 383/5, 69, 79, 383/81, 34.1; 24/30.5 R, 30.5 L

[56] References Cited

U.S. PATENT DOCUMENTS

| | | | |
|---|---|---|---|
| 672,897 | 4/1901 | Giltner | 383/34.1 |
| 684,656 | 10/1901 | Watson | 383/69 |
| 686,948 | 11/1901 | Nason | 383/81 |
| 1,071,991 | 9/1913 | Ebert | 383/69 |
| 1,361,605 | 12/1920 | Morrill | 383/69 |
| 1,371,934 | 3/1921 | Reynolds | 383/69 |
| 2,017,698 | 10/1935 | Levy | 383/69 |
| 2,064,432 | 12/1936 | Keidel | 383/5 |
| 2,599,520 | 6/1952 | Turner | 383/69 |
| 2,616,470 | 11/1952 | Rifkin | 383/5 |
| 5,354,132 | 10/1994 | Young et al. | 383/69 |

FOREIGN PATENT DOCUMENTS

| | | | |
|---|---|---|---|
| 335602 | 2/1959 | Switzerland | 383/81 |

*Primary Examiner*—Stephen P. Garbe
*Attorney, Agent, or Firm*—Darby & Darby

[57] ABSTRACT

A bag with a security closure having two opposing main segments corresponding to the bag front panels, and a pair of side segments at each end of the opposing main segments which are foldable about a crease line, the upper edges of the front panel segments and side segments defining the bag mouth. A stiffening bar is provided at the upper edge of each of the main segments and side segments, the stiffening bars being formed in a group when the bag segments are folded to close the bag mouth. There is a closure bar having a U-shape channel with an inwardly extending flange at each end and the group of stiffening bars fits within the inwardly extended flanges of the U-shaped channel as the closure bar is moved over the group of segments with the flanges being below the group of stiffening members. A locking member is fastened to the end of the closure bar to prevent its withdrawal from the bag and a receiver for the locking member can be on a piece that is articulated from the closure bar.

15 Claims, 5 Drawing Sheets

1
2
3
4
5
6
10
F

SAFETY LOCKING FOR A BAG

FIELD OF THE INVENTION

This invention refers to a security closure for a bag, which is intended for the transportation of securities and confidential documents and for mail in general.

BACKGROUND OF THE INVENTION

A security container, or bag, is known in which there is stiffening of the edges of the cloth which make up the bellows-folded mouth of the container. This has two large bars corresponding to the long sides and four smaller bars corresponding to the lateral edges, two on each of which, in the closed position, are positioned parallel between the two first bars in order to cause a thickened region, which can be placed in the interior of the longitudinal cavity of a closing channel type bar, which has the shape of an inverted "U" and edges in the form of wings protruding inward. The thickened edges are inserted into one end of the closing channel bar, which is open, sliding in until stopped at the other, closed, end. The end of the closing channel has a locking member which longitudinally passes beyond the bag mouth is closed by the transverse placement of the shackle of a padlock, a seal or other element, which prevents its return.

At their mouths, the sacks mentioned have closing means, which are provided with a padlock to prevent violation or with a security seal to make certain that they have not been opened during their transport.

Said closing means generally consist of a zig-zag threading of cords, belts or metal strips through holes placed near the two edges, facing each other.

This type of closing means has the disadvantage that there are various small openings between the holes which, when the closing line is gathered, form creases, through which it is possible to gain access to the interior of the sack without having to destroy the seals attached to the cords or other strips threaded through the holes, or to open the padlocks.

If such edges are provided with small folds, through which stiffening bars are inserted, it becomes difficult for them to be gathered but at the same time, however, the two lips can be forced apart sufficiently along the segments referred to, so that the contents of the bag can be extracted.

On the other hand, it is minor disadvantage that the operation of closing by threading provides a certain amount of difficulty to the user.

The subject invention aims to optimize the use of the above-mentioned sacks, providing them with an effective and safe closure, which is easily handled.

BRIEF DESCRIPTION OF THE INVENTION

The invention concerns a bag with a bellows-folded mouth, the folded edge of which accommodates segments of stiffening bars, the two longer segments correspond to the bag front panels and the four smaller ones correspond to the bag side portions which, when folded inward, become parallel to each other.

The edges thus closed make up a linear thickening, which is greater than the width of the body of the bag. The thickening is inserted by sliding its end axially into a closure bar having an inverted "U"-shaped cross-section. The bag edges each have longitudinal entering flanges, the clearance between those flanges being larger than the width of the body of the container, but smaller than the width of the above-mentioned linear thickening.

In this manner, the profile described prevents upward removal of contents from the bag by forming a roof, which seals the bag with its web.

At its rear end, the closure bar has a transverse wall, which acts as a stop for the insertion slide of the stiffening bars. The length of the wall is slightly greater than the width of the sack and has holes on each side of the overhang, passing through both wings of the metal shape, can be used for the placement of a seal and/or padlock.

Alternatively, cover is provided on the end corresponding to the seal, either in the form of an exterior block or a retractable internal plate hinged on a transverse axis near to and parallel to the interior of the web of the closure bar, in an intermediate position between the end of the mouth of the bag and the transverse holes thereof, acting in such a manner that, when the bag is slid into the closure bar, it is positioned in a plane parallel to said web above the edge of the container, then falling once its length has been exceeded and transversely covering the interior of the bar.

As an accessory and not as an excluding requirement, the "U"-shaped metal bar can be equipped with a handle on top.

Another alternative, which corresponds to the functional characteristics described, is the use of stiffening bars attached to the edges of the mouth of the bag, the transverse shapes of which form a simpler closing operation.

This involves bars, which are attached externally to each of the major edges of the mouth of the bag, have an internal longitudinal cavity above the edge of the cloth and a longitudinal external channel, as well as four bars firmly attached to the edges of the lateral segments, which can be bellows-folded and, on their longitudinal edges above the edge of the cloth, each have thickenings of a cross-section equivalent to the longitudinal internal cavities of the above bars, within which they are placed in a closed position for insertion into the closing bar, the winged edges of which, guided by the outside longitudinal bars described, slide in the entering direction up to the rear stop.

Said operative simplification is made possible by a prior stopped position of the thickened edges of the smaller bars within the longitudinal cavities of the larger bars, facilitating their insertion into the closing bar and preventing damage to the cloth because the edges of their retaining tracks do not contact the cloth but rather slide through the guide channels.

Finally, another alternative variation of means of closing the open insertion end of the closing bar is made up in this case of a transverse cap of cross-section similar to that of the closing bar, with two lateral wings provided with holes which, in the closed position, coincide with similar holes in the wings of the inverted "U" shape at their end zones, for the insertion of the seal or the shackle of the padlock, and with hinged arms articulated on pins, which protrude from the sides of the closing bar and can be extended as runners.

BRIEF DESCRIPTION OF THE DRAWINGS

In order to make the advantages discussed in this summary more concrete and thereby facilitate the understanding of the design and functional characteristics of the inventive closure for securities and confidential documents, a preferred embodiment and variations, which are illustrated diagrammatically and not to a specific scale in the attached drawings, are described below.

DETAILED DESCRIPTION OF THE INVENTION

Figures 1, 2, 3:
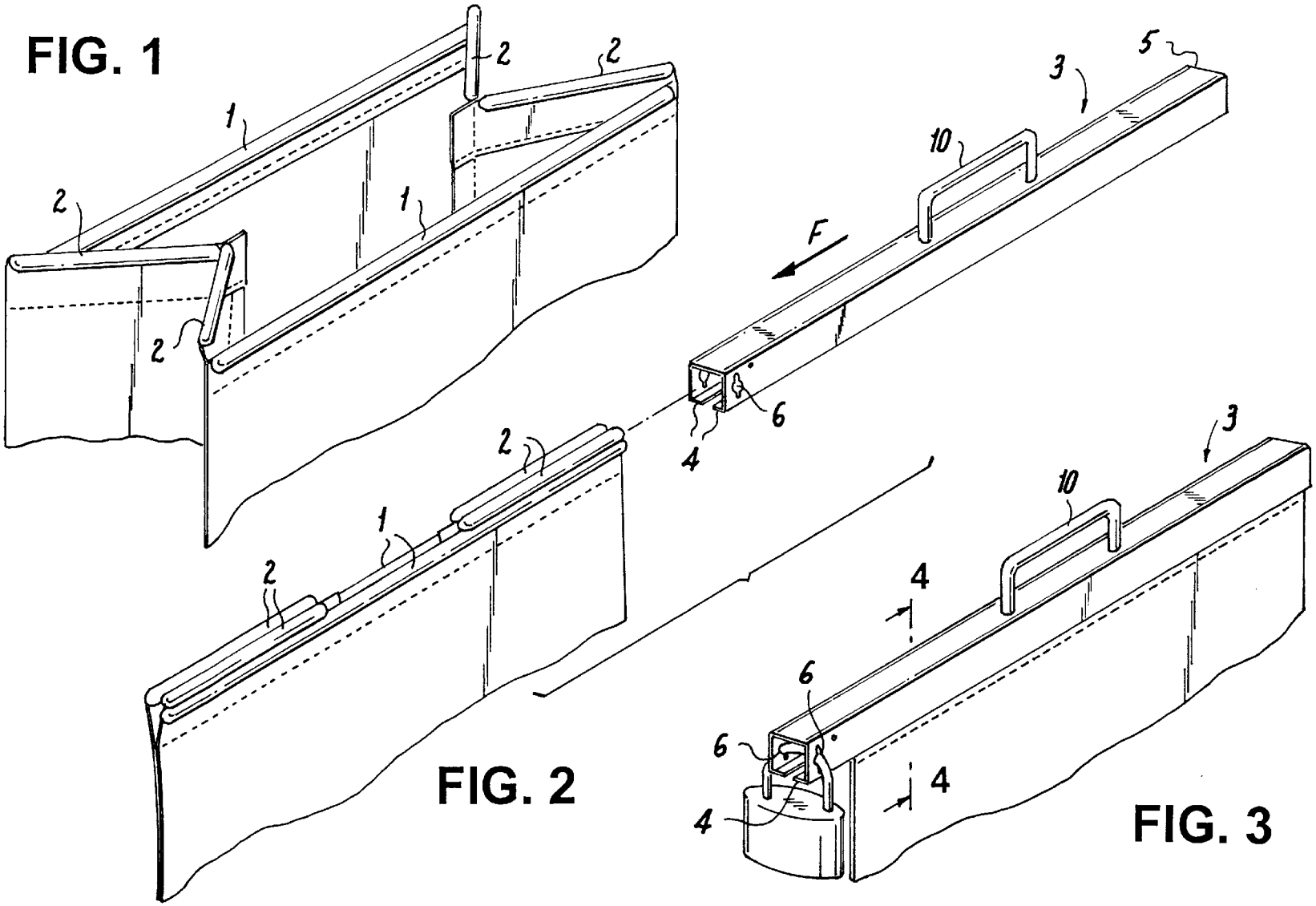
FIG. 1 is a perspective view of the mouth of a security bag in accordance with the invention shown as the semi-folded state, with stiffening bars in its hems.
FIG. 2 is a view of the bag of FIG. 1, with the mouth of the bag totally closed ready for insertion into the closure bar.
FIG. 3 is a view of the bag of FIGS. 1 and 2, with the closure bar installed and a padlock placed in its transverse holes.

As can be seen in FIG. 1, the mouth of the container bag is shaped for folding and made up of two frontal segments 1 and four minor segments 2, the upper edge of each of the segments having an attached stiffening bar. Those bars, which correspond to the side segments 2 are placed to a higher level than those of the frontal segments, in such a manner that, in the closing position shown in FIG. 2, they are grouped in two superimposed pairs and their inside surfaces are in contact. FIG. 2 also shows a closure bar 3 which can be of metal, with a U-shaped channel. The closure bar is designed so that, as it advances in direction F, the stiffening bars of the segments are inserted into the cavity of the U-shaped channel held from below by the inwardly extending flanges 4 of the channel until the stiffening bars reach a stop in the back wall 5 of the closure bar so that the closure bar is installed as shown in FIG. 3. This shows the final positioning of the closure bar which also has transverse holes 6 in its walls protruding beyond the folded bag stiffening segments for the placement of a padlock, shown, or a security seal, which prevents the bag from being opened. That is, with the padlock in place the closure bar cannot be slid off the bag.

Figure 4:
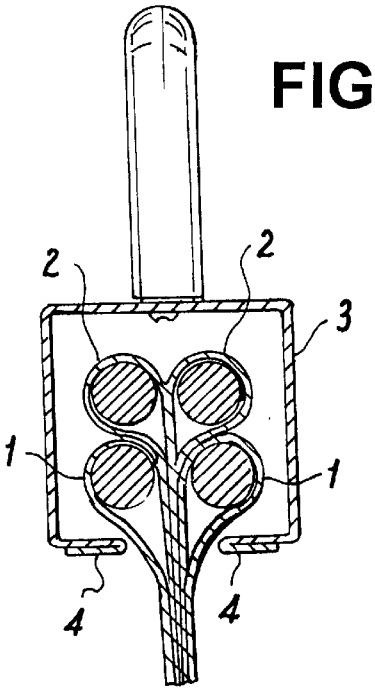
FIG. 4 represents a cross-section of the closure bar in the plane "A", indicated in FIG. 3.

In an enlarged detail drawing of the transverse section indicated as "A" in FIG. 3, FIG. 4 shows the bulk formed by the four bag segments each having a stiffening bar contained in a hem at the top edge of the respective bag segment and held by the flanges 4 of closure bar 3.

Figure 5:
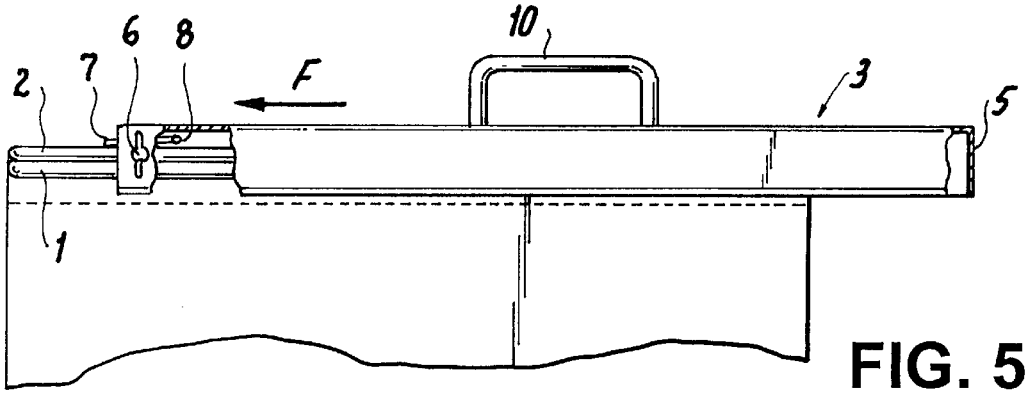
FIG. 5 shows an elevation view of the closure bar half in place, with partial sections, which shows the rear stop of the closure bar and a variant of the fold-up front cover.

FIG. 5 illustrates an intermediate position in the closing operation and in the partial sections of one of the wings of the U-shaped metal closure bar 3 illustrating how a fold-up cover 7 is positioned over the channel of closure bar 3 rotating on a transverse axis 8 on the closure bar 3 as well as on the stop wall 5.

Figure 6:
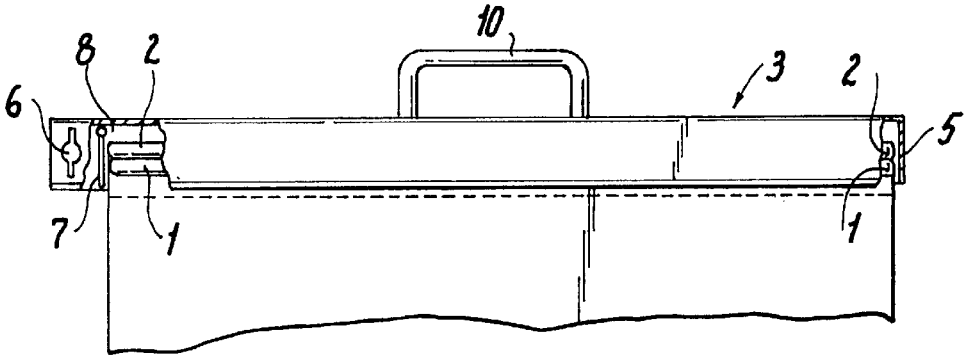
FIG. 6 is a view of the embodiment of FIG. 5 with the closure bar completely installed.

FIG. 6 shows the closure bar 3 in a closed position and shows the final positioning of the transverse holes 6 and the above-mentioned cover 7, closing the cavity of the U-shaped channel of closure bar 3 between them and the corresponding end of the mouth of the bag.

Figure 7:
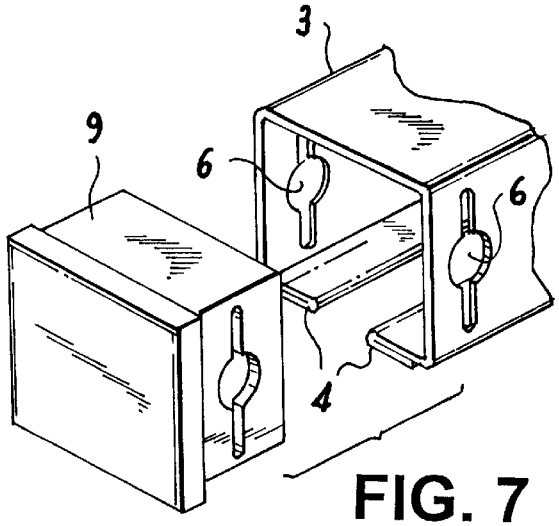
FIG. 7 illustrates, in perspective, the end of the closure bar of FIGS. 5 and 6 with an alternative form of a plug-type cover.

A plug 9, shown in FIG. 7, is an alternative which, appropriately adjusted, enters the end of the channel of the closure bar 3 and has transverse holes, which coincide with the holes 6 of the bar in order to block them with locking elements passing through the holes.

In FIGS. 2, 3, 4, 5 and 6, reference numeral 10 corresponds to an optional handle for the closure bar 3 which is useful for carrying it.

FIGS. 8 to 12, which are described below, illustrate two variations for optimizing the operational usefulness of the closure within the basic functional characteristics represented by FIGS. 1 to 4. FIGS. 8 to 12 illustrate stiffening bars for the segments with a special shape and the hinged fold-up cover at the end of the closure bar 3, which may be applied independently, although it is shown as part of a single embodiment.

Figures 8, 9:
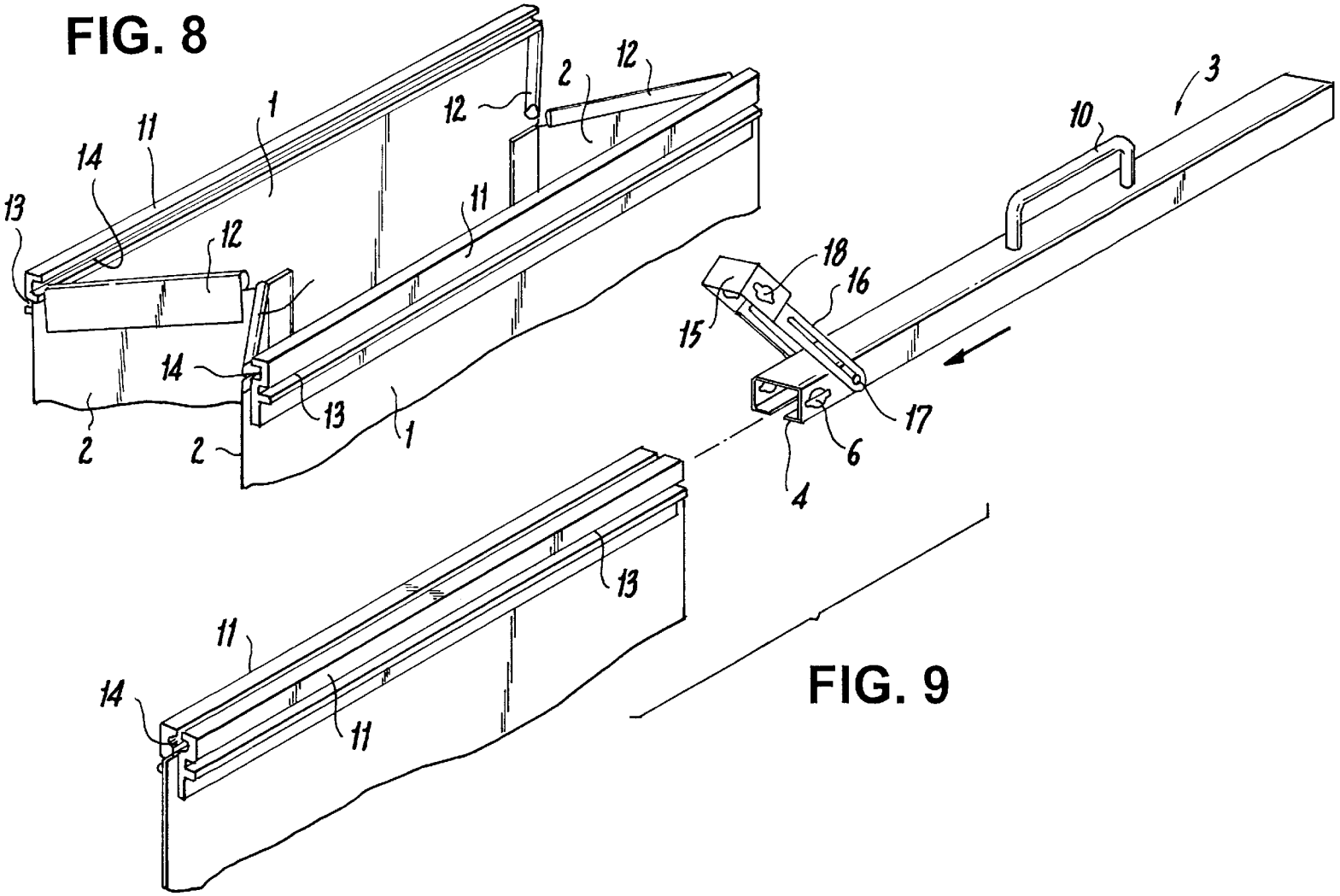
FIG. 8 is a perspective view of the mouth of a partly folded security bag with an alternative embodiment of stiffening bars with different cross-sections.
FIG. 9 is a view of the embodiment of FIG. 8 with the mouth of the bag totally folded and the closure bar ready for insertion, provided with an articulated cover.

As shown in FIG. 8, the bag, for purposes of folding, has two front and rear segments 1, to the upper edges of which are firmly attached to the stiffening bars 11, and of four smaller side segments 2, having firmly attached at their upper edges to the stiffening bars 12.

The outer faces of each of the larger stiffening bars 11 has a longitudinal channel 13, which serves as guides for the flanges of sliding closure bar 3, illustrated in later Figures, while the inner faces have longitudinal cavities 14, within which are housed, properly adjusted when the bag mouth is folded, the thickened portions of the smaller corresponding stiffening bars 12. This is illustrated in FIG. 9, which shows the closure bar 3 with its flanged edges 4 projecting in the direction of the channels 13 already referred to.

Figure 10:
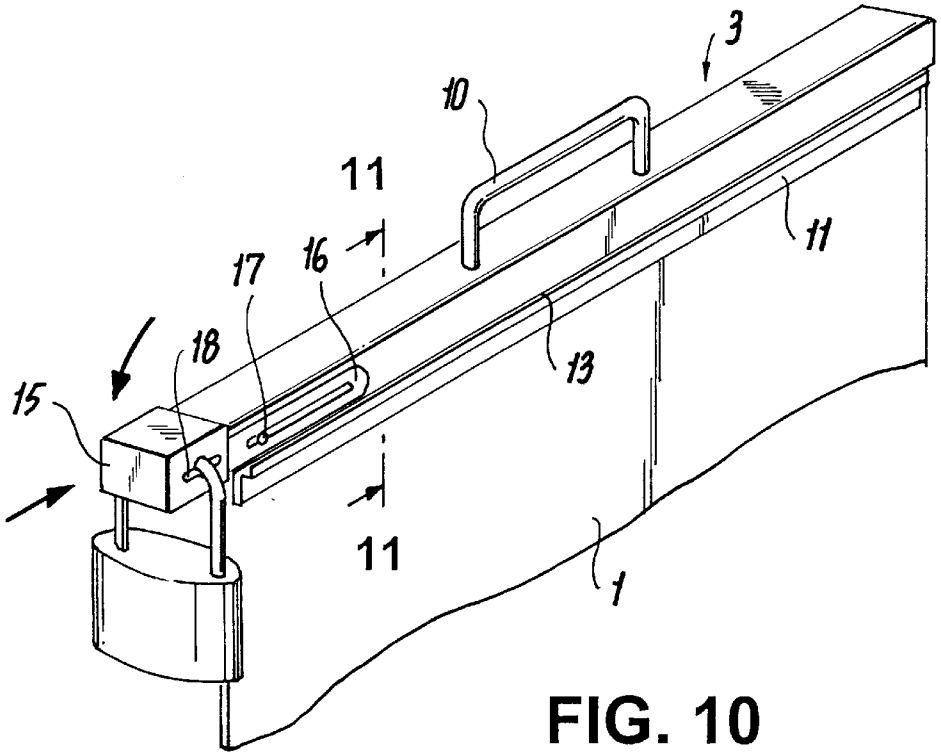
FIG. 10 is a view of the bag of FIGS. 8 and 9 with the closure bar and a padlock installed, preventing extraction of the closure bar.

FIG. 9 also shows an articulated closing device 15 having the openings 21 for accepting the closing device therethrough at its outer ends with the inner ends connected to the closure bar 3 by means of arms 16, connected to the bar 3 by pivot pins 17. In FIG. 9 the closing device 15 is shown in an extended and elevated position in order to permit the insertion of the folded mouth of the bag into the channel of the closure bar 3 until it reaches the position shown in FIG. 10, in which said closing device 15 is pivoted downwardly and retracted by sliding the arms 16, which has slots 17 over the pivot pins until the holes 18 overlie the holes 6 of bar 3. When the shackle of the padlock passes through the holes 6 of the bar and holes 18 of the plug 9, as shown in FIG. 10, if used, extraction of the bar 3 from the bag is prevented.

Figure 11:
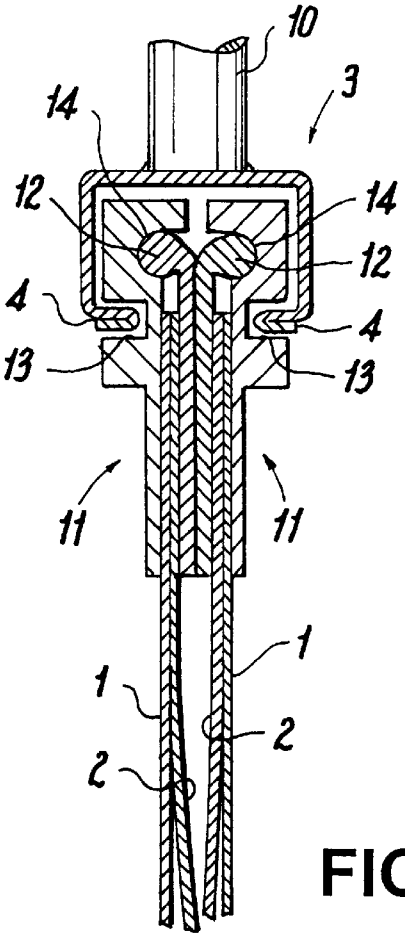
FIG. 11 is a cross-section of the closure bar on the plane "B" indicated in FIG. 10.

FIG. 11 shows the manner in which the cavities 14 of the stiffening bars 11 contain the stiffening bars 12 of the bag smaller side segments. The channels 13 on the outer face of each of the stiffening members 11 position the closure bar 3 flanges 4 without the possibility of transverse movement.

Figure 12:
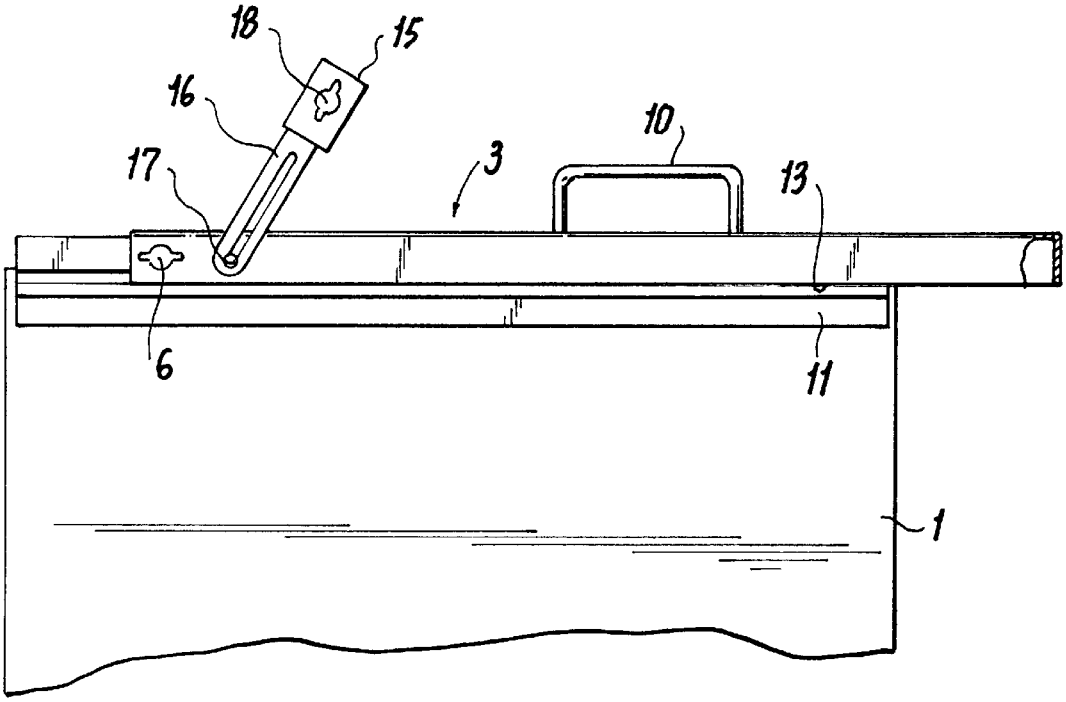
FIG. 12 is a view in elevation of the closure bar shown in FIGS. 8, 9, 10 and 11, with the closure bar partly installed.
Figure 13:
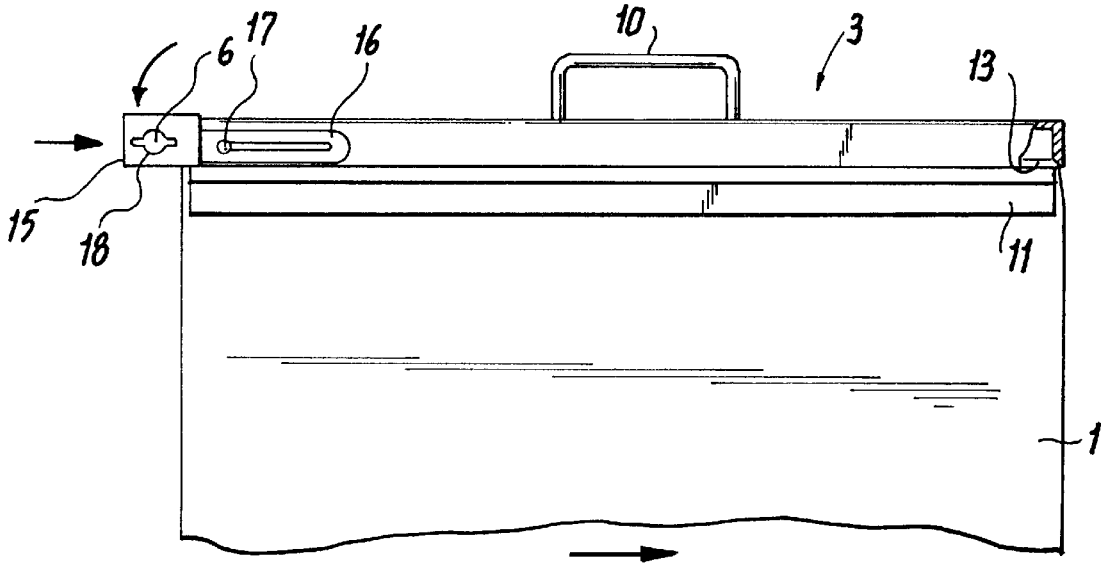
FIG. 13 is a view of the bag of FIG. 12 with the articulated cover in the closed position.

Finally, FIGS. 12 and 13 diagrammatically show two sequential positions of closing the bag; the first shows the closure bar 3 sliding toward its closing position with the articulated closing stop 15 raised and the arms 16 extended on the pivot pins 17. In the second, the closure bar 3 has completely traversed its closing path and is stopped with its transverse wall 5 against the back end of the bar channel, the closing device 15 preventing it from returning. The position of the closing device 15 at the front of the closure bar 3 is adjusted by retracting the arms 16 so as to align the holes 6 of the closing channel with the holes 18 of the closing device 15 for the insertion of a padlock or seal.

The security closure for a bag of securities and confidential documents described and exemplified, along with its alternative variations, is included within the scope of protection determined by the claims, which follow.

Having described and determined the nature and scope of this invention and the manner in which it can be put into practice, it is declared that what is claimed as exclusive property is:

1. A bag with a security closure comprising:

a bag having two opposing main segments, and a pair of side segments at each end of said opposing segments which are foldable about a crease line, the upper edges of said main segments and side segments defining the bag mouth;

a stiffening bar at the upper edge of each of said main segments and side segments, said stiffening bars formed in a group when said segments are placed to close the bag mouth;

a U-shaped closure bar having a channel with an inwardly extending flange at each side, said group of stiffening bars fitting within said channel as said closure bar is moved over said group with said flanges being below said group of stiffening members; and said closure bar having an opening in each of its sides to accept a closing device therethrough to lock said closure bar to the bag.

2. A bag as in claim 1 wherein said closure bar has a stop at one of its ends to limit sliding of said closure bar relative to said group of stiffening members.

3. A bag as in claim 2 wherein said openings are at the other end of said closure bar.

4. A bag as in claim 1 wherein said stiffening bars of said side segments are at different heights relative to stiffening bars of said main segments such that on folding of the segments to close the mouth of the bag, the said group is formed with said stiffening bars of said side segments and said stiffening bars of said main segments being at different height levels.

5. A bag with a security closure comprising:

a bag having two opposing main segments; and a pair of side segments at each end of said opposing segments which are foldable about a crease line, the upper edges of said main segments and side segments defining the bag mouth;

a stiffening bar at the upper edge of each of said main segments and side segments, said stiffening bars formed in a group when said segments are placed to close the bag mouth;

said stiffening bars of said main segments having a longitudinal groove on the inner face thereof to accept the stiffening bars of the folded side segments;

a U-shaped closure bar having a channel with an inwardly extending flange at each side, said group of stiffening bars fitting within said channel as said closure bar is moved over said group with said flanges being below said group of stiffening members.

6. A bag with a security closure comprising:

a bag having two opposing main segments; and a pair of side segments at each end of said opposing segments which are foldable about a crease line, the upper edges of said main segments and side segments defining the bag mouth;

a stiffening bar at the upper edge of each of said main segments and side segments, said stiffening bars formed in a group when said segments are placed to close the bag mouth; the outer face of each of said stiffening bars of said main segments having a longitudinal groove on the outer face to accept a flange of said closing channel;

a U-shaped closure bar having a channel with an inwardly extending flange at each side, said group of stiffening bars fitting within said channel as said closure bar is moved over said group with said flanges being in said grooves of said stiffening members of said main segments.

7. A bag with a security closure comprising:

a bag having two opposing main segments; and a pair of side segments at each end of said opposing segments which are foldable about a crease line, the upper edges of said main segments and side segments defining the bag mouth;

a stiffening bar at the upper edge of each of said main segments and side segments, said stiffening bars formed in a group when said segments are placed to close the bag mouth; said stiffening bars of said main segments having a longitudinal groove on the inner face thereof to accept the stiffening bars of the folded side segments; and wherein the outer face of each of said stiffening bars of said main segments has a longitudinal groove to accept the flanges of said closing channel;

a U-shaped closure bar having a channel with an inwardly extending flange at each side, said group of stiffening bars fitting within said channel as said closure bar is moved over said group with said flanges being in said grooves of said stiffening members of said main segments.

8. A bag as in claim 1 further comprising an articulated piece pivotally mounted to said closure bar and having an opening to overlie said opening in said wall of said closure bar.

9. A bag as in claim 8 wherein said articulated piece comprises a pair of spaced arms each having one end pivotally mounted to said closure bar and a block at the other end having a piece attached thereto having said opening.

10. A bag as in claim 1 wherein said closure bar has an opening on each of its walls to accept a closing device passing therethrough to lock said closure bar to the bag.

11. A bag as in claim 10 further comprising an articulated piece rotatably mounted to said closure bar and having an opening in said wall to overlie said opening of said closure bar.

12. A bag as in claim 11 wherein said articulated piece comprises a pair of spaced arms each having one end pivotably mounted to said closure bar and a block at the other end having a piece attached thereto having said opening.

13. A bag as in claim 1 further comprising a plug for fitting into said end of said channel and having an opening corresponding to said at least one opening to accept a closing device.

14. A bag as in claim 1 wherein there is a said opening in each wall of said closure bar and further comprising a plug for fitting into an end of said channel and having openings corresponding to each of said openings of said closure bar to accept a closing device.

15. A bag as in claim 1 further comprising a handle mounted to said closure bar.

* * * * *

UNITED STATES PATENT AND TRADEMARK OFFICE

CERTIFICATE OF CORRECTION

PATENT NO. : 6,074,094

DATED : June 13, 2000

INVENTOR(S) : Jorge Eleuterio Manolizi and Walter Gabriel Sidlik

It is certified that errors appear in the above-identified patent and that said Letters Patent is hereby corrected as shown below:

Title page, [54] Title is incomplete. Please change "SAFETY LOCKING FOR A BAG" to -- IMPROVEMENTS IN THE SAFETY LOCKING FOR A BAG --.

Signed and Sealed this

Third Day of April, 2001

*Attest:*

Nicholas P. Godici

NICHOLAS P. GODICI

*Attesting Officer*

*Acting Director of the United States Patent and Trademark Office*